United States Patent [19]

McNally et al.

[11] 4,227,354

[45] Oct. 14, 1980

[54] ROOF TO WALL CONNECTION FOR A RAILWAY CAR

[75] Inventors: George S. McNally, South Holland, Ill.; Richard C. Snyder, Michigan City, Ind.

[73] Assignee: Pullman Incorporated, Chicago, Ill.

[21] Appl. No.: 1,081

[22] Filed: Jan. 5, 1979

[51] Int. Cl.[2] ..... B61D 17/12

[52] U.S. Cl. ..... 52/56; 52/15; 52/96; 403/242

[58] Field of Search ..... 52/56, 96, 95, 15, 588; 105/410; 403/242, 231; 29/521

[56] References Cited

U.S. PATENT DOCUMENTS

| | | | |
|---|---|---|---|
| 217,002 | 7/1879 | Decrow | 52/15 |
| 782,979 | 2/1905 | Mathews . | |
| 1,112,717 | 10/1914 | Neal | 52/56 |
| 1,204,259 | 11/1916 | Egger | 52/15 |
| 1,230,720 | 6/1917 | Kellogg . | |
| 1,255,309 | 2/1918 | Hawksworth et al. . | |
| 3,303,619 | 2/1967 | Janecek . | |
| 3,909,918 | 10/1975 | Takizawa et al. | 29/509 |
| 3,909,919 | 10/1975 | Miyabayashi et al. | 29/509 X |

*Primary Examiner*—James A. Leppink
*Assistant Examiner*—Carl D. Friedman
*Attorney, Agent, or Firm*—Stephen D. Geimer

[57] ABSTRACT

A connection for joining the edges of a roof sheet to the wall of a railway car without the use of fasteners such as rivets or welds. The connection is weather-tight and includes an interlock feature which effectively carries the loading encountered during operation of the vehicle. A modified version of the interlock forms a trough for channeling water towards the ends of the railway car.

8 Claims, 6 Drawing Figures

FIG. 2
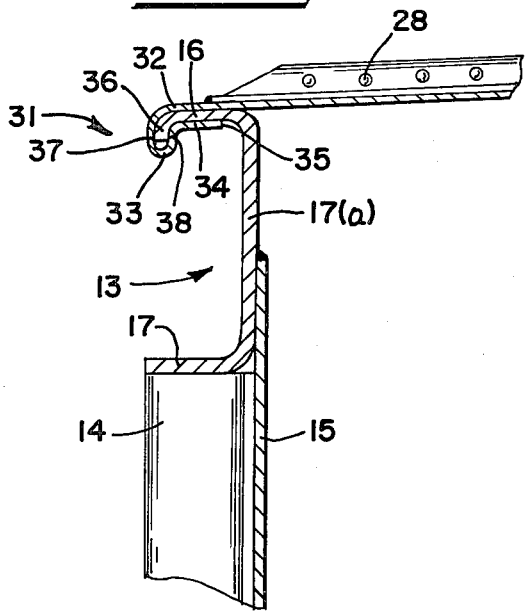
FIG. 3
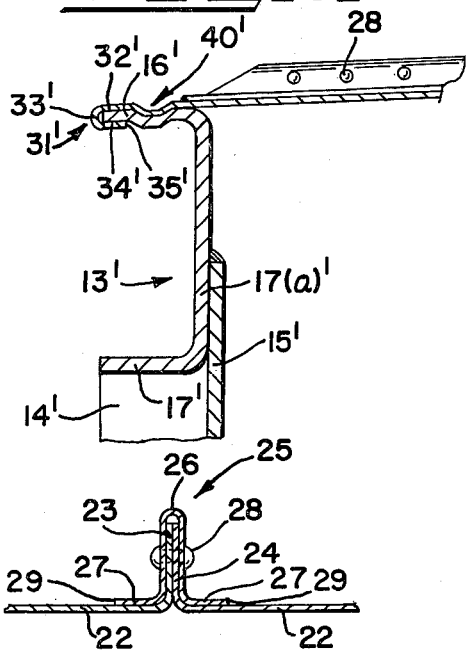
FIG. 4
FIG. 5
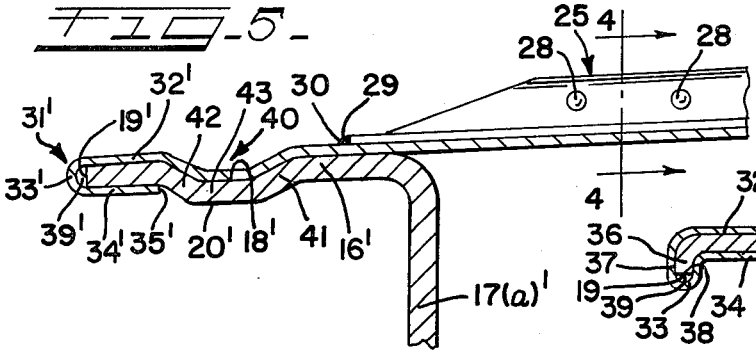
FIG. 6
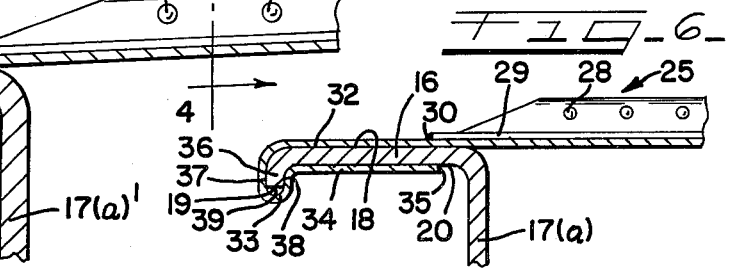
FIG. 1
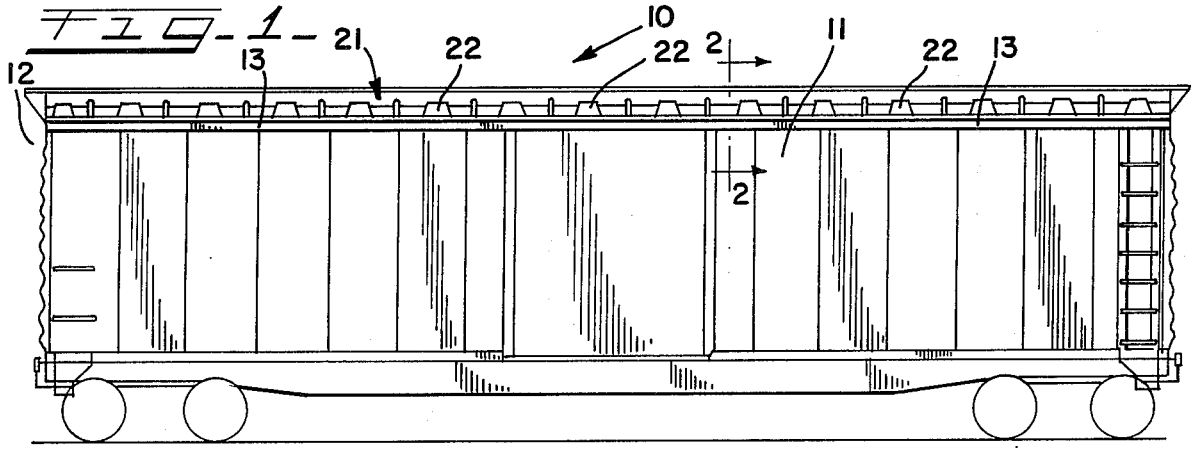

ROOF TO WALL CONNECTION FOR A RAILWAY CAR

BACKGROUND OF THE INVENTION

1. Field of the Invention

The invention relates to railway cars and particularly a connection for joining the edges of the roof sheets to the walls of a railway car.

2. Description of the Prior Art

The prior art includes U.S. Pat. Nos. 782,979; 1,255,309; 1,230,720; 3,303,619 and 3,909,918.

U.S. Pat No. 3,909,918 discloses a structure and method for joining relatively light gauge sheet metal edges such as would be utilized in an automobile car door. U.S. Pat. No. 3,303,619 discloses a structure and method of joining the edges of the sheet metal used in forming the walls of an industrial oven.

U.S. Pat. No. 1,255,309 is typical of the prior art railway car patents. As best shown in FIGS. 1, 4 and 6 the sheet metal roof wraps down around and under the side flanges of the wall structure. However, it should be noted that there is no interlock feature and in this type of structure the sheet metal roof edge and the flange members are not load carrying members. E.g., as shown in FIG. 4 in the roof structure disclosed, the loads are carried by the side plate A, which is bolted to the bracket C by vertically and transversely extending bolts D and E. The sheet metal roof functions as a covering which overlaps the roof structure. U.S. Pat. Nos. 782,979 and 1,230,720 are similar to the patent discussed above.

The prior art also includes railway car roof sheets having edge portions which are bolted or welded to the flanges of the side plate. If the connection utilizes a bolt or rivet the holes are usually drilled prior to assembly. During assembly the holes in the roof sheet edge portion must be aligned with the holes in the adjacent flange. This is time consuming and requires relatively close manufacturing tolerances. If the connection utilizes a weld, typically the roof sheet edge portion would be welded to the upper surface of the side plate flange. This results in a longitudinally extending weld seam. During use a railway car is subjected to cyclical twisting about a longitudinal axis. This type of cyclical loading over long periods of time may result in failure of the weld at the points of maximum flexure of the vehicle. Weld failure diminishes strength and also increases the chances of leakage into the interior of the car.

The present invention is an improvement over the prior art.

SUMMARY OF THE INVENTION

The present invention relates to a connection for mating the roof to the wall of a railway car without the use of rivets or welds. The side walls of a railway car include side plates located proximate the upper part of the wall. The edge portion of the roof extends over, around and under and is in abutting contact with the upper and lower surfaces of the side plate flange. The arrangement provides a weather-tight connection and also facilitates assembly of the vehicle. The connection is provided with an interlock or shear lock that is adapted to carry the loading encountered during rail car operations.

In the first embodiment the interlock comprises a downwardly directed portion located at the free edge of the upper flange. The edge portion of the roof sheet has a first section in abutting contact with the first or top surface of the upper flange and the external side of the downwardly directed portion. The edge portion has a fold nose which overlaps the edge of the flange and is connected to the second section of the upper flange. The second section is wrapped against the internal side of the downwardly directed portion and the second or lower surface of the upper flange. The fold nose and the edge of the upper flange form a space allowing for slight flexure of the flange.

In the second embodiment the roof sheet edge portion has a first section which is in abutment with the top surface and a second section in abutment with the lower surface of the upper flange of the side plate. The first and second sections are connected by a fold nose which wraps around the edge of the upper flange. The fold nose and the edge of the flange form a space which allows for slight flexure of the flange. The interlock comprises a downwardly offset portion formed in the upper flange of the side plate and the first section of the roof sheet edge portion. The interlock forms a trough which reduces streaking of the car by channeling water towards the ends of the vehicle.

BRIEF DESCRIPTION OF THE DRAWINGS

FIG. 1 is a side elevational view of a railway car including the roof to wall connection.

FIG. 2 is a cross-sectional view of the first embodiment of the roof to wall connection taken along line 2—2 of FIG. 1.

FIG. 3 is a cross-sectional view of the second embodiment of the roof to wall connection similar to FIG. 2.

FIG. 4 is a cross-sectional view of the seam cap and adjacent roof sheets taken along line 4—4 of FIG. 2.

FIG. 5 is an enlarged cross-sectional view of the roof to wall connection shown in FIG. 3.

FIG. 6 is an enlarged cross-sectional view of the roof to wall connection shown in FIG. 2.

DESCRIPTION OF THE FIRST EMBODIMENT

FIG. 1 discloses a railway car generally designated by the reference numeral 10. The railway car 10 includes a pair of vertically and longitudinally extending side walls 11 only one of which is shown. The car also includes a pair of vertically extending end walls 12.

As best shown in FIGS. 2 and 6 the upper portion of each side wall 11 includes a longitudinally extending side plate or beam 13 which extends the length of the side wall 11. The side wall includes side sheathing 14 and an inner wall 15. The side plate 13 is connected to the side sheathing 14 and inner wall 15 by welding or other means well known in the art.

The side plate 13 is a generally channel shaped beam that has outwardly facing upper and lower flanges, 16 and 17 respectively, connected by a web 17*a*. The upper flange has a first or top surface 18, a free edge 19 and a lower or second surface 20.

The roof, generally designated 21, includes a plurality of corrugated panels or sheets 22. As best shown in FIG. 4 the sheets 22 have upstanding flanges 23 and 24 abutting one another. The flanges 23 and 24 are covered by a seam cap 25. The seam cap 25 includes a U-shaped portion 26 that is adapted to fit over the flanges 23 and 24. A pair of flanges 27 extend outwardly from the lower edges of the U-shaped portion 26. The upstanding flanges, 23 and 24, and the U-shaped portion of the seam cap 25 are provided with a plurality of holes adapted to receive bolts or rivets 28. Each seam cap 25 has outer margins 29 which are connected to the upper surface of the roof sheet by a weld 30.

The roof sheets or panels 22 have edge portions generally designated by reference numeral 31. The edge portion 31 includes a first section 32 which overlaps and is in abutment with the first surface 18 of the upper flange 16. A fold nose 33 is connected to the first section and overlaps the edge 19 of the flange. A second section 34 extends inwardly from the fold nose 33 and is in abutment with the second surface 20 of the upper flange 16. The second section 34 also includes a free end portion 35 which terminates on the second or lower surface 20 of the upper flange 16. It should be noted that the free end portion 35 and the lower surface 20 of the flange 16 form an interface which is protected from the elements. This helps to insure a weather-tight connection and aids in preventing seepage due to capillary action.

The roof to side plate connection includes an interlock which provides for a secure connection without the use of fastening means such as rivets or welding. In the first embodiment the interlock comprises a downwardly directed portion 36 located at the outer edge of the flange 16 of the side plate. The downwardly directed portion has an external side 37 and an internal side 38. The roof sheet edge portion 31 is wrapped against and in abutment with the external and internal sides 37 and 38 of the downwardly directed portion. The fold nose 33 and the free edge 19 of the flange 16 form a space 39. The space 39 allows for slight flexure of the downwardly directed portion due to car body bouncing during operation and due to sagging of the vehicle between the trucks.

The structure provides effective resistance to the loads encountered during use of the vehicle. Inwardly directed loading on the walls 14 occurs due to lading strap (not shown) reactions. The lading straps extend between the sidewalls 14 and are used to hold the cargo in place. Outwardly directed loading occurs due to bulging of granular loads or shifting of package goods. Vertical loads occur due to car body bouncing during rail operations and also due to end to end twisting of the car about a longitudinal axis.

The interlock eliminates the need to use rivets or bolts to attach the upper flange 16 of the side plates 13 to the roof sheet edge portion 31. This also eliminates the necessity of drilling holes to accommodate the rivets and problems associated with aligning the holes during manufacturing. Since holes in the upper flange 16 and edge portion 31 do not have to be aligned the roof sheet panels may be moved longitudinally during assembly to accommodate for manufacturing tolerances.

The interlock also eliminates the use of longitudinally extending welds to connect the roof sheet edge portion 31 to the upper flange 16. During operation the railway car tends to twist about a longitudinal axis. The twisting imposes cyclical loading on the car. Maximum cyclical loading occurs at the upper corners of the car and elimination of the longitudinally extending weld in this area improves the fatigue resistance of the roof to side plate connection.

DESCRIPTION OF THE SECOND EMBODIMENT

As best shown in FIGS. 3 and 5 the side plate 13' is a generally channel shaped beam that has outwardly facing upper and lower flanges, 16' and 17' respectively, connected by a web 17a'. The upper flange has a first or top surface 18', and edge 19' and a lower or second surface 20'. The roof 21' is comprised of a plurality of corrugated panels as described above in the first embodiment.

The roof sheets or panels 22' have edge portions 31'. The edge portion 31' includes a first section 32' which overlaps and is in abutment with the first surface 18' of the upper flange 16'. A fold nose 33' is connected to the first section 32' and overlaps the edge 19' of the flange 16'. A second section 34' extends inwardly from the fold nose 33' and is in abutment with the second surface 20' of the upper flange 16'. The second section 34' also includes a free end portion 35' which terminates on the second surface 20' of the upper flange 16'. The fold nose 33' and the edge 19' form a space 39'. The space 39' allows for slight flexure of the upper flange 16' due to bouncing of the car body during operation and due to sagging of the car between the trucks.

As best shown in FIGS. 3 and 5, in the second embodiment the interlock includes a longitudinally extending downwardly offset portion 40 formed in the first section of the roof sheet edge portion 32' and the upper flange 16'. The downwardly offset portion includes essentially flat first and second legs, 41 and 42 respectively, extending upwardly and outwardly from an essentially bottom portion 43. In addition to providing the load carrying advantages of the interlock described above, the downwardly offset portion 40 forms a trough for channeling water towards the end of the car thereby minimizing streaking of the car side walls 11. The roof sheet second section 34' is in abutment with the lower surface 20' of the upper flange 16'. The second section 34' includes a free end 35' which terminates proximate the second leg 42 of the downwardly offset portion 40. Thus this arrangement also provides for a weather-tight seal.

Modifications and variations of the present invention are possible in light of the above teachings. It is, therefore, to be understood that within the scope of the appended claims, the invention may be practiced otherwise than as specifically described.

What is claimed is:

1. A connection for attaching a roof to a wall of a railway car, said connection comprising:

means having an outwardly extending flange at the upper edge of said wall, said flange having a first upper surface, a free edge and a second lower surface, a roof sheet having an edge portion, said edge portion having first and second sections and a fold nose disposed therebetween, said fold nose overlapping said free edge of said flange and spaced therefrom, said first section being in abutment with said first surface of said flange and said second section extending from said fold nose and in abutment with second surface of said flange, and means for interlocking said roof sheet portion and said outwardly extending flange including complemental downwardly offset portions formed in said first section of said roof sheet edge portion and said flange thereby forming a weather-tight joint.

2. The connection according to claim 1, wherein said offset portion of said flange extends downwardly and terminates at said free edge.

3. The connection according to claim 1, wherein said offset portion of said flange is spaced laterally inwardly of said free edge.

4. The connection according to claim 3, and said second section having its terminal end spaced away from said offset portion of said flange.

5. The connection according to claim 1, wherein said downwardly offset portions extend substantially horizontally in a longitudinal direction with respect to the railway car, thereby forming a channel for diverting water to the ends of the car.

6. The connection according to claim 5, wherein said downwardly offset portion comprises substantially flat first and second legs extending upwardly and outwardly from a substantially flat longitudinally extending bottom portion.

7. A connection for attaching a roof to a wall of a railway car, said connection comprising:

means having an outwardly extending flange at the upper edge of the wall, said flange having a first surface and a second surface with a downwardly extending end portion disposed therebetween, said downwardly extending end portion including external and internal sides disposed about a free edge, a roof sheet having an edge portion, said edge portion having a first section overlapping and in abutment with said first surface of said flange and a second section overlapping and in abutment with second surface of said flange, said edge portion further having a nose portion between said first and second sections, said nose portion disposed about and spaced from said free edge, said first section overlapping and in abutment with said external side of said end portion, and said second section overlapping and in abutment with said internal side of said end portion thereby forming a weather-tight joint.

8. The connection according to claim 7, wherein said roof sheet second section includes an end portion;

said end portion terminating on the second surface of the flange and in protective relation therewith.

* * * * *